United States Patent [19]

Gassaway

[11] 4,007,613

[45] Feb. 15, 1977

[54] EQUIPMENT SECURITY LOCKING DEVICE

[76] Inventor: James Scott Gassaway, 2356 Glendon Ave., Los Angeles, Calif. 90064

[22] Filed: Aug. 1, 1975

[21] Appl. No.: 601,189

Related U.S. Application Data

[62] Division of Ser. No. 498,658, Aug. 19, 1974, Pat. No. 3,910,079.

[52] U.S. Cl. ..... 70/58; 70/461; 70/DIG. 57

[51] Int. Cl.[2] ..... E05B 73/00

[58] Field of Search ..... 70/57, 58, 229, 232, 70/461, DIG. 57, DIG. 58, 230, 231; 248/23, 25, 203

[56] References Cited

UNITED STATES PATENTS

| | | | |
|---|---|---|---|
| 1,809,685 | 6/1931 | Foval | 248/25 |
| 2,541,418 | 2/1951 | Herrick | 248/23 |
| 2,664,616 | 5/1972 | Raskin | 70/58 X |
| 2,707,659 | 5/1955 | Sloyan | 248/23 X |
| 3,605,460 | 9/1971 | Singer | 70/232 |
| 3,744,282 | 7/1973 | Hemphill | 70/58 |

*Primary Examiner*—Robert L. Wolfe
*Attorney, Agent, or Firm*—D. Gordon Angus; Donald D. Mon

[57] ABSTRACT

A security device for protecting equipment such as typewriters, calculators and the like, comprises a base member having a hole through which the shank of a bolt passes through a mounting body and into the frame or housing of the equipment to be protected, the head of the bolt being held at a seat within the base member. A protective envelope has an end member positioned to be juxtaposed to, and cover, a portion of the base member around the seat to prevent access to the bolt head. The end member has a threaded hole through it communicating with the bolt head, and a lock body having a barrel with a threaded protruding neck which engages the threaded hole, fits within a hollow shank of the protective member. The lock body contains a number of transversely slidable locking blades which resiliently protrude from the barrel to engage spline stops of the shank when in the normal locked position. The lock body can only be unthreaded from the threaded hole when the proper key is inserted into the lock body to force withdrawal of the blades from the locking position, thereby uncovering the bolt head so that access may be had to it. An adjustable bar on a table attaches to the equipment and a locked anchor bolt fastens to the bar.

6 Claims, 16 Drawing Figures

FIG. 11
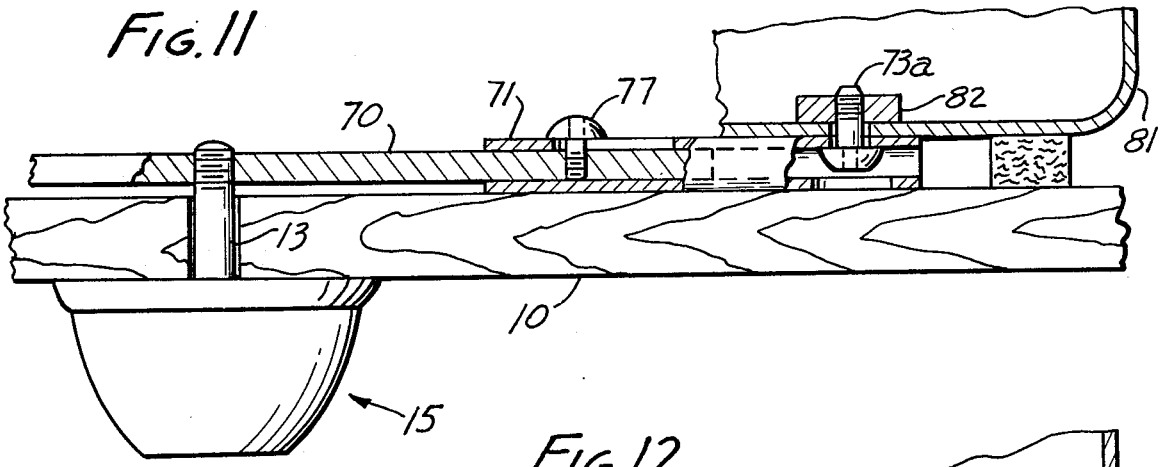
FIG. 12
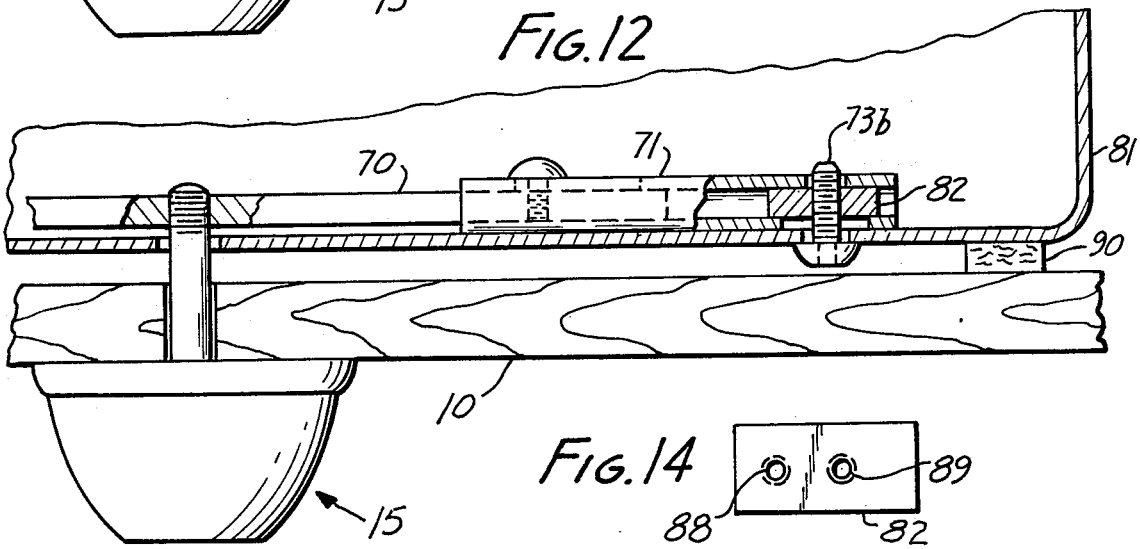
FIG. 14
FIG. 13
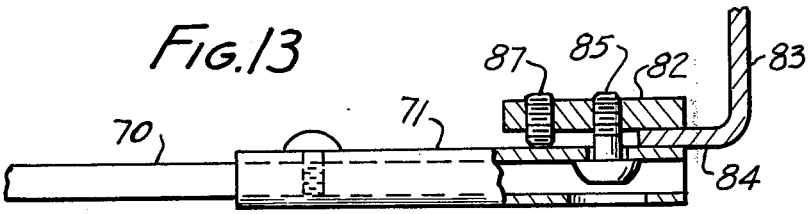
FIG. 15
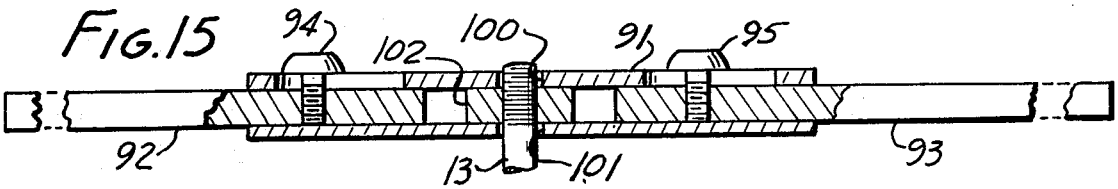
FIG. 16
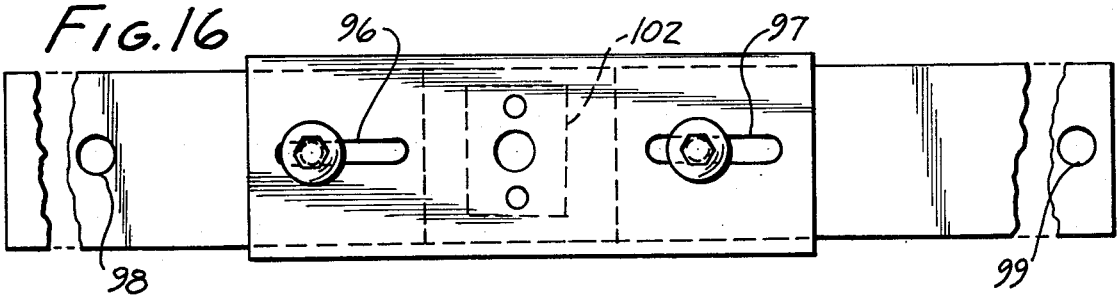

EQUIPMENT SECURITY LOCKING DEVICE

This is a division, of application Ser. No. 498,658, filed August 19, 1974 now U.S. Pat. No. 3,910,079.

This invention relates to security devices for fastening equipment such as office equipment, for example typewriters, adding machines and computers and other more or less similar equipment such as microscopes, televisions, projectors, safes and the like, to their mounting surfaces; and more particularly to such security devices which are lockably attached to the mounting surface.

It has long been a problem within business and other organizations and buildings to avoid loss or misplacement of relatively small costly items of equipment such as typewriters and other business machines and the like due to unauthorized moving of such equipment from place to place, and to thievery and burglaries. Various expedients have been used to reduce such unauthorized movement or loss of such equipment.

Bolting and bolt locking and cable or chain locking of equipment to a mounting surface has heretofore been used. A common method of doing this has been to drill a hole or holes through the mounting surface and bolt through the surface into the equipment to be secured thereto. Furthermore, locking covers have heretofore been placed over the bolt or stud or nut so that they cannot easily be removed. The security of such expedients depends to a great extent on how difficult it is to break or pry away the locking device.

An object of the present invention is to provide a locking device which is relatively difficult to remove or damage.

Another object is to provide a locking device which occupies a minimum of space, is simple to handle, and has smooth outer surfaces which do not damage clothes of people and cannot easily be broken or damaged.

Another object is to provide a bar arrangement on which there can be mounted an equipment to be protected, the bar arrangement being protected by a locking device.

The invention is carried out by provision of a protective locking device having a base member adapted to abut the side of the mounting table or body opposite that to which the equipment is attached. The base member has a hole through it through which the shank of an anchor bolt passes from within the base and protrudes through the mounting body to the equipment into which it fastens as by threads. The side of the base opposite its outer surface has a seat at the hole which prevents the bolt head within the base from passing through the hole. A protective member envelops the seat and has an end member positioned to be juxtaposed to, and cover, a portion of the base member around the seat, and a threaded hole through this end member provides communication with the bolt head. A hollow shank attached to the protective member protruding away from the seat is provided with spline means at its inner surface, and within this hollow shank and spline means there is inserted the barrel of a lock body having a protruding threaded neck which engages the threaded hole of the end member. The barrel is of the so-called tumbler type in that it contains transverse groove means provided with locking blade means slidable transversely through the groove means and resiliently urged in a direction which causes them normally to protrude from the side of the barrel so as to engage the spline means, which prevents their rotation, thereby locking the barrel. The barrel is provided with a key-slot adapted to receive a key which engages the blade means to withdraw them from engagement with the spline means so that the barrel may then be rotated to disengage its threaded neck from the threaded hole, so that the lock body may be removed from the shank to permit access to the bolt head. The protective member is provided with a shielding envelope which prevents access to its interior while the locking blade means of the lock body are engaged by the spline means.

In another aspect there is provided a bar means adapted to be placed on a table top or the like with provision for fastening the equipment to be protected to the bar means in a manner which prevents easy access to the fastening means. The bar means itself is arranged to be protected by a locking device.

In one aspect the bar means comprises a strip attachable to the locking device with sleeves slidable over the strip and to which the equipment is fastened. In another aspect the bar means comprises a sleeve attachable to a locking device with strips extending from either side of the sleeve and with provision for fastening the equipment to be protected to the strips.

Features reside in a manner of adjusting the length of the bar means and for protecting the fasteners attaching the bar means to the equipment, from ready access.

The foregoing and other features of the invention will be better understood from the following detailed description and the accompanying drawings of which:

FIG. 11 is an elevation view, partially in cross-section, showing another arrangement for protecting an equipment;

FIG. 12 shows still another arrangement for protecting an equipment;

FIG. 13 shows an arrangement modified from those of FIGS. 10 and 11, for protecting an equipment;

FIG. 14 is a top view of part of the components shown in FIG. 12;

FIG. 15 is a partial view, partly in cross-section, showing still another modified arrangement for protecting an equipment; and FIG. 16 is a top view of the arrangement of FIG. 12.

Figure 1:
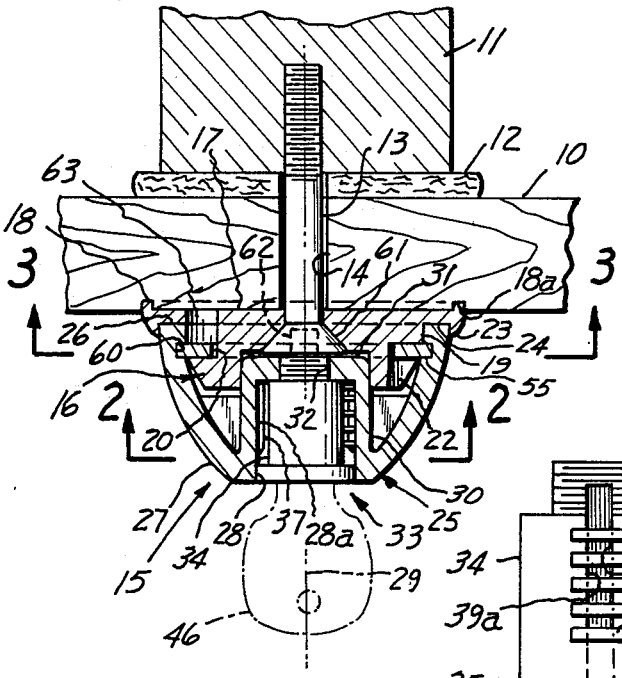
FIG. 1 is an elevational cross-section view taken at line 1—1 of FIG. 2, showing a locking device according to this invention in locking relationship with an equipment to be protected.
Figure 2:
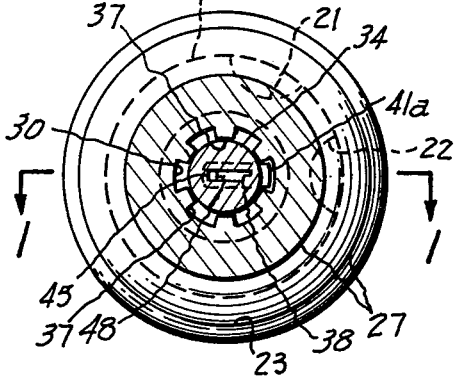
FIG. 2 is a cross-section view taken at line 2—2 of FIG. 1.
Figure 3:
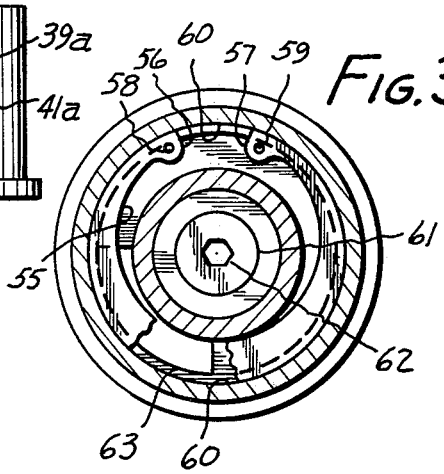
FIG. 3 is a cross-section view taken at line 3—3 of FIG. 1.

Referring to FIGS. 1, 2 and 3 there is shown a portion of a mounting member such as a table or desk 10 or the like, on which is mounted an equipment to be protected such as a typewriter, calculator or other equipment, of which a portion such as a leg 11 is shown with a padding 12 of felt or the like, according to a common practice between the bottom of the portion 11 and the top of the table. The equipment is bolted to the mounting table by a bolt 13 passing up through the bottom of the table through a hole 14, through the table and threaded into the member 11 of the equipment. Access to the bolt is prevented or inhibited by a protective locking device 15 according to this invention.

The locking device 15 comprises a base member 16 having a flat circular base element 17 adapted to be placed flat against the under surface of the table 10. Preferably a circumferential rim 18 extends outwardly from the periphery of the base element 17 so as to fit within a corresponding annular groove 18*a* formed in the under surface of the table. A circular boss 19 extends inwardly from the base element 17 and a peripheral groove 20 is formed in the boss a short distance inward from the flat base element 17. Inward from the groove the boss is provided with a pair of spaced notches 21 and 22 for a purpose to be explained later. The side of circular base element 17 opposite annular rim 18 has an upstanding annular lip 23 and the diameter of the boss 19 at base element 17 is less than that of the lip 23 so that an annular space or groove 24 is left between the lip and the boss.

There is fitted over the base member 16 a bell-shaped protective cover member 25 having a peripheral rim 26 which fits into the groove 24, and having a bell-shaped side envelope 27 provided with a circular opening 28 (in the absence of a lock body described below) co-axial with the longitudinal axis 29 of the cover 15, the base 16 and the bolt 13. At the opening 28 there is provided a well formed by the inner cylindrical wall 28*a* of a cylindrical shank 30 and an inner end member 31 through which there is a threaded hole 32 co-axial with the longitudinal axis 29. The cylindrical wall 28*a* is co-axial with, and has the same diameter as opening 28.

Within the cylindrical shank 30 there is inserted a lock body 33 shown separately in FIGS. 4 through 7. The lock body is generally similar to a well-known tumbler type of lock, but adapted to the protective device of this invention. The lock body has a cylindrical barrel 34 and a cylindrical disc-shaped head 35 at the outer end of the barrel and has at its inner end a protruding threaded nipple 36 co-axial with the axis of the barrel and dimensioned to thread into the threaded hole 32 of the well. The diameter of the disc 35 is dimensioned to fit easily within the opening 28 and the diameter of the cylindrical barrel is less than that of the internal diameter of cylinder 28*a*, leaving an annular space between the barrel and the cylinder. The inner wall of the cylinder 28*a* has fixed to it a plurality of equally spaced splines 37 extending parallel to the longitudinal axis 29 and the diameter of barrel 34 is such that the barrel fits easily within these splines.

Figure 8:
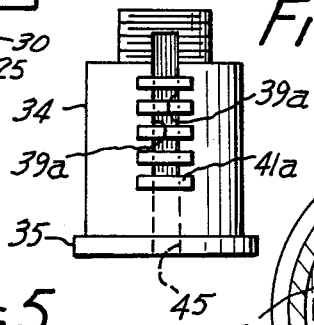
FIG. 8 is a view of the lock body turned 90° from the view shown in FIG. 4.
Figure 6:
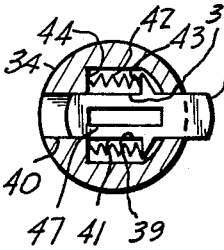
FIG. 6 is a cross-section view taken at line 6—6 of FIG. 4, showing the normal position of the locking blade means, no key being inserted.

The cylindrical barrel 34 is hollow between the threaded nipple 36 and the disc 35 and is provided with a longitudinal slot 38 extending transversely through it. At opposite sides of the slot there are spaced transverse ledges 39 which appear as juxtaposed teeth 39*a* (best seen in FIG. 8) at one end of the slot. At the opposite end of the slot the ledges merge into spaced webs 40 across the slot. A lock member in the form of a blade 41 is set in the space between each adjacent pair of ledges and each blade is loaded by a pair of compression springs 42 compressed between shoulders 43 of the blade and shoulders 44 of the slot, which urge the lock member to slide in the direction which causes one end 41*a* to protrude outward beyond the circumference of the barrel as shown in FIG. 6, the opposite end of the latch member then being some distance within the circumference of the barrel.

Figure 5:
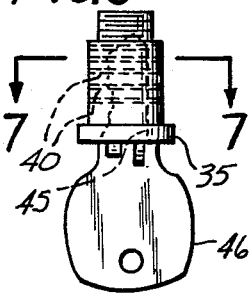
FIG. 5 is an elevation view of the lock body of FIG. 4 with a key inserted in its key-way, part of the interior and of the key being shown dotted.
Figure 7:
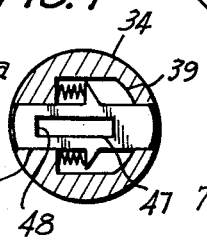
FIG. 7 is a cross-section view taken at line 7—7 of FIG. 5, showing the position of the locking blade means when the key is inserted.

The disc member 35 is provided with a key-way 45 adapted to receive a key 46 shown in FIG. 5 and in phantom in FIG. 1. This key-way extends through the blades of the barrel as will now appear. The internal portion of each blade 41 is provided with an opening 47, as best seen in FIGS. 6 and 7, so that the key inserted through the key-way can pass through the opening and have its keying edge move against a camming edge 48 of the opening 47 of each blade, and in doing so the key will act as a cam causing the blade to slide against the compression of its springs so that the end 41*a* which normally protrudes from the barrel as shown in FIG. 6 now moves inward to coincide with or lie within the circumference of the barrel as shown in FIG. 7, so that no part of the blade protrudes from the circumference of the barrel. The particular shape and dimensions of the openings 47 of the respective blades will ordinarily be different in correspondence with the configuration of the particular key which is to fit this particular lock body. In accordance with conventional tumbler lock practice, different parts of the key will slide different respective ones of the blades.

The bell-shaped envelope 27 is assembled to the base member 16 by bringing its peripheral rim 26 into and against the annular surface of the groove 24 of the base member. In doing this the inner wall of the envelope is moved past a resilient snap ring 55 whose ends 56 and 57 are separated with a gap between. The snap ring is placed within the groove 20 of the base member. In order to use the resilient ring it is first inserted into the groove 20. To do this the ring must be resiliently expanded, which can be done by applying a tool to the end holes 58 and 59 of the ring while the ring is oriented so that these holes register with openings 21 and 22. When the ring is sufficiently expanded it will fit over the part of the boss 19 which is remote from the flat surface 17 and thus reach the groove 20 into which it snaps when the expanding tool releases it. In order to move the peripheral end of the bell-shaped envelope passed the snap-ring it is necessary to pull the ends of the snap-ring toward each other within groove 20 to reduce its diameter sufficiently so that the peripheral end of the envelope may pass it. For this purpose the holes 58 and 59 are again grasped by a tool which will pull the ends of the ring together while the peripheral end of the envelope is passing over the snap-ring. To do this the tool will be inserted from outside the device through an arcuate slot 63 formed through the base portion 17 at a position opposite recesses 21 and 22. Then the tool will release the ends of the snap-ring and will be withdrawn and the end of the envelope will be brought flush with the groove 24. In this position, the resilient snap-ring expands into a peripheral groove 60 formed in the inner surface of the bell-shaped envelope. Thus the snap-ring is partially within the groove 60 and also partially within the groove 20, so that the envelope cannot be removed from the base member.

In this position the bolt 30 extending through the hole in the table and threaded into member 11 of the equipment is now completely inaccessible except through the threaded hole 32 which is co-axial with the bolt and with a recessed head 61 of the bolt shown as having a hexagonal shape 62 adapted to be fitted by an Allen type wrench. In order to reach the bolt head with a wrench, it is necessary that the lock body 33 be removed from the locking device so that the wrench can be inserted through the cylindrical member 30 and through the hole 32 to the bolt head.

Figure 4:
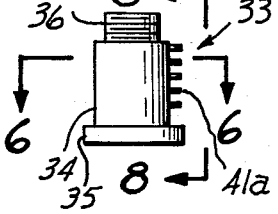
FIG. 4 is an elevation view of a lock body included in the locking device of FIG. 1.

In order to prevent access through this hole 32 the end 36 of the lock body must be threaded into the hole 32 which covers the bolt head and prevents access into the well formed by cylinder 28*a* by reason of the cylindrical disc portion 35 which fills the entrance to the well. In order to thread the lock body to the tapped hole 32 in this manner it is necessary that the key 46 shown in phantom in FIG. 1 be inserted through the key-hole and through the openings 47 through the openings of the several locking blades 41 to slide the blades laterally against the spring pressures so that their protruding ends as indicated in FIGS. 2 and 4 are brought flush with or within the cylindrical surface of the barrel 34. The reason for this is that the lock body cannot be turned while the blades are protruding because the group of blades, when protruding, will always protrude into a space between an adjacent pair of splines 37, which will act as stops preventing the rotation. But with the key fully inserted into the lock body, the lock body can be rotated which is done by applying torque to the key. Turning the lock body by use of the key will cause it to be firmly threaded to the hole 32. Then when the key is withdrawn the resilient springs of the locking members causes them to protrude beyond the circumference of the lock body as indicated in FIGS. 4 and 6, so that they now occupy one of the spaces between a pair of spline stops and the lock body cannot be rotated to remove it unless the proper key is inserted into it.

There are numerous ways by which a locking device according to this invention may be used. The arrangement of FIG. 1 can be used where an equipment to be protected has a central portion or leg corresponding to the member 11 of FIG. 1. Where the equipment to be protected has a number of legs, for example four corner legs, one of the locking devices can be used at each leg in the manner shown in FIG. 1, or at a pair of diagonally opposite legs. The more locking devices used in such cases of multiple legs, the less likelihood there is of equipment being pried off the table by grasping an unlocked corner.

Other arrangements for protecting equipment are illustrated in FIGS. 9 through 16. These expedients serve to reduce the number of such locking devices required for a given degree of protection. The arrangement of FIG. 9 involves the use of a strip 70 of a strong material such as metal, provided near its ends with sleeves 71 also of strong material, which can slide lengthwise relative to the strip. The underside of the sleeve is provided with a relatively large opening 72 through which a screw 73 and its head 74 can be passed. A smaller hole 75 through the upper part of the sleeve and aligned with opening 72 provides for passage of the threaded screw shank but not the head 74, so that the screw can be threaded into the leg 76 of an equipment such as a typewriter. The opposite sleeve is similarly fastened by a screw to another leg of the equipment. The slidability of the sleeves permits adjustment so that the holes 75 through the sleeves can be made to coincide with the distance apart of the legs of the equipment, and the sleeves can then be fastened in this position by cap screws 77 passing through slots 78 in the upper part of the sleeve and threading into the strip 70. At the central position of the strip 70, there is provided a threaded hole 79 into which the screw 13 of the locking device is threaded after passing it through a hole 80 through the table or desk on which the equipment is placed. Thus, the locking device 15 protects the screw 13 against access as the lower parts of the sleeves 71 are placed flat on the table top. Since the strip 70 and its sleeves 71 are of strong rigid material, the equipment cannot readily be pried away from the table by grasping it at either of the two legs 76.

Figure 9:
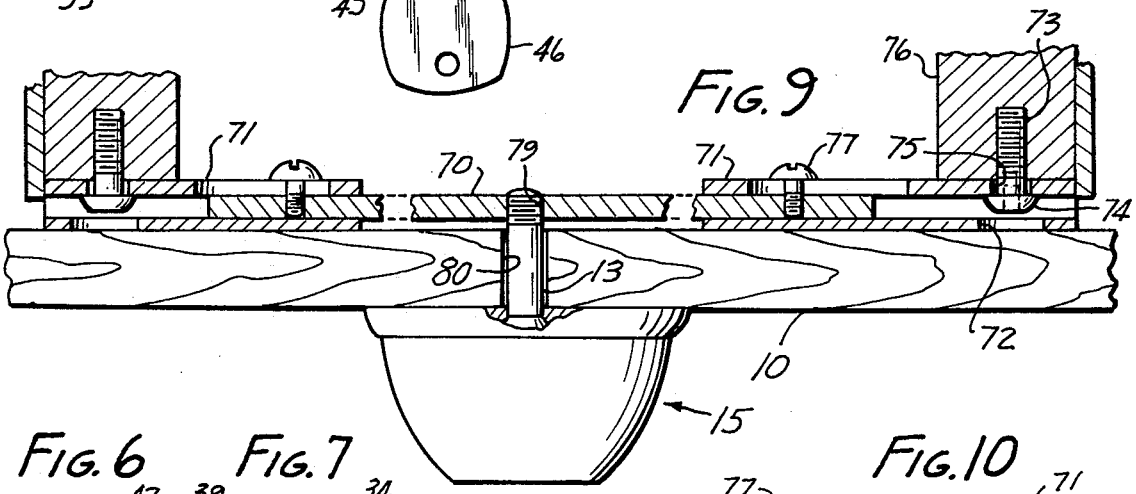
FIG. 9 is an elevation view partially in cross-section, showing an arrangement for locking a component to be protected in a manner somewhat different from that shown in FIG. 1.
Figure 10:
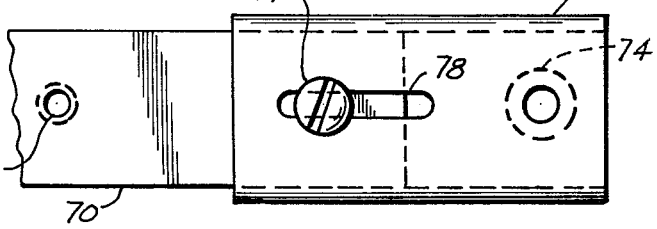
FIG. 10 is a top view of a part of the protective arrangement illustrated in FIG. 9.

In FIG. 11 there is shown an arrangement which differs from that of FIGS. 9 and 10 in showing the use of a device 15 for protecting an article such as a locked metal cabinet of which a lower corner 81 including parts of a side and base appear in FIG. 11. A strip 70 and sleeve 71 are used similarly to the arrangement in FIG. 9, but instead of threading a screw 73 into the device to be protected, a screw 73*a* passing through the upper portion of the sleeve and through the base of the cabinet threads into a nut plate 82 within the cabinet. Since the cabinet is assumed to be normally locked, the nut is inaccesible. It is also assumed in FIG. 11 that the base of the cabinet will extend to the left to another corner of the cabinet, which is not shown in the figure, where a similar sleeve with a screw 73*a* and nut plate 82 will be used. In this case, the base of the cabinet will ordinarily be provided with an indent or a hole to accommodate the head of cap screw 77.

In the arrangement of FIG. 12, the base of the locked cabinet 81, of which only part is shown in the figure, passes beneath the strip 70 and sleeve 71 and, instead of a nut plate 82 placed against the top surface of the cabinet base, the nut plate 82 placed between the upper and lower surfaces of sleeve 71, and there is a screw 73*b* whose head abuts the bottom surface of the cabinet base and whose shank passes through holes through the cabinet base and through the upper and lower surfaces of the sleeve 71 as well as through the threaded hole of the nut plate. In this arrangement it will be desirable to have a nut plate 82 which fits the inside of the sleeve to prevent the nut plate from turning. The left side of the cabinet will ordinarily be fastened similar to the right side shown in FIG. 12. The arrangement is useful where footings 90 such as felt or the like are placed between the cabinet and the table 10.

FIGS. 13 and 14 show another arrangement for protecting a member which may be a locked cabinet or the like having a depending side or leg 83 turned inward at its base at 84. The screw 85 has its head abutting the under surface of the upper part of sleeve 71 and its threaded shank is threaded into a plate 82 so that the inwardly extending portion 84 is sandwiched between the upper surface of the sleeve and the under surface of nut plate 82. In order to hold the plate in a horizontal position there is an adjusting screw 87 threaded through a hole 88 of the plate with its lower end abutting the sleeve to hold the plate parallel to the sleeve. The sleeve is placed on a table ordinarily with another sleeve on the strip 70 to the left of sleeve 71 shown in the figure, with the sleeves resting on or slightly above the table, or desk, or the like, and the strip 70 and sleeves are protected by a protective device 15 and anchor bolt (not shown in FIG. 13) similar to the corresponding arrangement of FIG. 12.

FIGS. 15 and 16 show still another arrangement wherein a single sleeve 91 suffices to hold two strips 92 and 93 by cap screws 94 and 95 passing through respective slots 96 and 97 to thread into the respective strips 92 and 93. Threaded holes 98 and 99 through the respective strips 92 and 93 can be used to thread a screw into them such as screws 94 and 95 whose heads are within the base of a cabinet or the like to fasten the cabinet to the strips. Alternatively, by using a screw of diameter somewhat smaller than that which threads into the holes 98 and 99, the screw head can be placed beneath the strips 92 and 93 and through the holes 98 and 99 without threading thereto, but threading into a member to be protected, such as is done by the screw 73 in FIG. 9, or by threading into a nut as the screws 73*a* and 73*b* in FIGS. 11 and 12, or by threading into a plate such as the screw 85 in FIG. 13. A protective device 15 will be applied with its anchor bolt 13 passing through holes 100 and 101 of the sleeve and threading into a nut 102 secured within the sleeve.

From the foregoing it is seen that there is provided an effective protective device for an anchor bolt, protecting equipment. The device is not easily forced or broken and, even if it can be forced or broken or broken into, it will take a relatively long time, which is often sufficient to prevent a theft or burglary. Time is a very important element in thwarting a theft or burglary. It is common for an alarm to be given during a burglary, and the success of a burglary often depends on how fast the burglar can lift the equipment being stolen and get away.

The arrangement of the lock body in the protective device makes "picking" of the lock difficult, and even if it can be picked, the task will be relatively time-consuming. It is noted that if it be attempted to pick the lock by inserting an instrument through the key-hole to move the blades or tumblers, a great number of picking operations will have to be performed. Actually, the number of such picking operations is equal to the number of splines within the well holding the lock body, multiplied by the number of threads which are engaged at nipple 36 within threaded hole 32. This would normally come to about 18 picking operations which would be inherently time-consuming. A reason the device cannot readily be broken is that the protective envelope cannot be grasped by a tool. Referring to FIG. 1, the radius of curvature of the envelope 27 in the plane of the sheet (or in any plane perpendicular to the plane of the sheet) is less than the diameter of the base member 17. For this reason, the protective envelope cannot be grasped by a wrench as would be the case if the envelope were cylindrical, as the wrench will simply slide on the curved surface. Furthermore, it cannot be grasped by a device such as a hollow pipe, as could be the case if its shape were cylindrical. It is further noted that the envelope 27 is free to turn within the base 17. While the base will be held from turning by its frictional contact with the mounting body 10, particularly as aided in this respect by the peripheral rim 18 in groove 18*a* of the mounting body, the envelope 27 on the other hand is relatively free to turn, because its periphery 26 at the base can turn in the groove 24 of the base. Hence, there is not the possibility of turning the bolt 13 by turning the base member 17 which could apply torque on the bolt head if the base were turned. Merely turning the envelope in the groove 24 will not turn the base member nor apply torque to the bolt which could unscrew it.

Moreover, even if the lock body be broken off, leaving the nipple 36 threaded to hole 32, it would still be a time-consuming task to remove the broken plug of the nipple in order to gain access to the bolt head of bolt 13.

Furthermore, the presence of the rim 18 within groove 18*a* of the mounting body makes it difficult to force a tool, such as a chisel, between the base and the mounting body for the purpose of breaking the protective device away.

In the specification and appended claims the terms "bolts" and "screws" are used interchangeably to mean a threaded fastener adapted for the purposes described. The terms "table" and "desk" and the like are used interchangeably to signify a platform through which the anchor bolt from the locking device may be passed to the region of the equipment to be protected.

It will be understood that the embodiments of the invention illustrated and described herein are given by way of illustration and not of limitation, and that modifications or equivalents or alternatives within the scope of the invention may suggest themselves to those skilled in the art.

I claim:

1. In combination:

bar means adapted for placing on the upper surface of a table and for mounting on said bar means an equipment to be protected;

an anchor bolt having a head and a threaded shank, the head being adapted to be placed beneath the under surface of the table and the shank being adapted to pass through the table and fasten to the bar means;

lock means adapted to be placed against the under side of said table and to envelop said head, thereby preventing access to the bolt except by unlocking of said lock means;

said bar means comprising a strip and two hollow sleeves spaced from each other within which said strip is slidable;

means holding said strip and sleeves against sliding relative to each other; and fastening means adapted to attach each of said sleeves to said equipment, said holding means and said fastening means being positioned so that they are covered by the equipment, and thereby rendered inaccessible, when the equipment is mounted on, and attached to, said bar means, whereby removal of the equipment from the bar means or the table is inhibited without unlocking said lock means.

2. In combination:

bar means adapted for placing on the upper surface of a table and for mounting on said bar means an equipment to be protected;

an anchor bolt having a head and a threaded shank, the head being adapted to be placed beneath the under surface of the table and the shank adapted to pass through the table and fasten to the bar means;

lock means adapted to be placed against the under side of said table and to envelop said head, thereby preventing access to the bolt except by unlocking of said lock means;

said bar means comprising a sleeve and two strips spaced from each other and slidable within said sleeve;

means holding said strips and sleeve against sliding relative to each other; and fastening means adapted to attach each of said strips to said equipment, said holding means and said fastening means being positioned so that they are covered by the equipment, and thereby rendered inaccessible, when the equipment is mounted on, and attached to, said bar means, whereby removal of the equipment from the bar means or the table is inhibited without unlocking said lock means.

3. A combination according to claim 1 in which both the upper and lower walls of said sleeve are each provided with aligned holes for passage of a fastening screw having a head, the hole through the lower wall being of great enough diameter to permit passage of the screw head and the hole of the upper wall being only of sufficient diameter to permit passage of the screw shank but not the screw head.

4. A combination according to claim 3 in which a nut plate having a threaded hole is placed within the sleeve so that the nut hole is in alignment with the holes through the upper and lower walls of the sleeve, the screw being threadable through the nut hole.

5. A combination according to claim 1 in which the shank of the anchor bolt is fastened to the strip at a position between the two spaced sleeves.

6. A combination according to claim 2 in which the shank of the anchor bolt is fastened to the sleeve at a position between the two spaced strips.

* * * * *